US010920501B2

(12) United States Patent
Levie et al.

(10) Patent No.: US 10,920,501 B2
(45) Date of Patent: Feb. 16, 2021

(54) EXPANSION CHAMBER

(71) Applicant: ANTELOPE OIL TOOL & MFG. CO., LLC, Houston, TX (US)

(72) Inventors: David E. Y. Levie, Kastanienbaum (CH); Richard Ronald Baynham, Marina di Ravenna (IT)

(73) Assignee: INNOVEX DOWNHOLE SOLUTIONS, INC., Houston, TX (US)

( * ) Notice: Subject to any disclaimer, the term of this patent is extended or adjusted under 35 U.S.C. 154(b) by 246 days.

(21) Appl. No.: 15/920,554

(22) Filed: Mar. 14, 2018

(65) Prior Publication Data

US 2018/0266188 A1 Sep. 20, 2018

Related U.S. Application Data

(60) Provisional application No. 62/471,072, filed on Mar. 14, 2017.

(51) Int. Cl.

| | |
|---|---|
| ***E21B 41/00*** | (2006.01) |
| ***E21B 17/00*** | (2006.01) |
| ***E21B 34/06*** | (2006.01) |
| ***F15B 1/24*** | (2006.01) |
| *E21B 17/10* | (2006.01) |

(52) U.S. Cl.

CPC ..... *E21B 17/006* (2013.01); *E21B 34/06* (2013.01); *E21B 34/063* (2013.01); *F15B 1/24* (2013.01); *E21B 17/1078* (2013.01); *E21B 41/00* (2013.01)

(58) Field of Classification Search

CPC ..... E21B 41/00; F15B 1/24

See application file for complete search history.

(56) References Cited

U.S. PATENT DOCUMENTS

| | | | | |
|---|---|---|---|---|
| 3,897,742 A * | 8/1975 | Hoffman | B63G 8/00 | 114/331 |
| 4,019,591 A * | 4/1977 | Fox | E21B 4/003 | 175/107 |
| 4,254,838 A * | 3/1981 | Barnetche | F16N 17/00 | 138/31 |
| 4,254,839 A * | 3/1981 | Schpok | E21B 10/246 | 175/228 |

(Continued)

FOREIGN PATENT DOCUMENTS

| | | |
|---|---|---|
| EP | 2038100 B1 | 9/2010 |
| WO | 2012/104574 A2 | 8/2012 |
| WO | 2016/114798 A1 | 7/2016 |

OTHER PUBLICATIONS

Hun Fil Lee (Authorized Officer), International Search Report and Written Opinion dated Oct. 29, 2018, PCT Application No. PCT/US2018/022299, filed Mar. 14, 2018, pp. 1-13.

(Continued)

*Primary Examiner* — Steven A MacDonald

(74) *Attorney, Agent, or Firm* — MH2 Technology Law Group LLP

(57) ABSTRACT

An expansion chamber for use on a tubular includes a shell that is configured to be attached to the tubular by a bonding material, the shell having a port configured to receive the bonding material therethrough and into a cavity of the shell. The expansion chamber also includes a tube unit configured to be placed in the cavity of the shell, the tube unit having a tube with a port that is in fluid communication with the port of the shell.

11 Claims, 11 Drawing Sheets

(56) References Cited

U.S. PATENT DOCUMENTS 4,328,873 A * 5/1982 Gonzalez ..... F16N 17/00 175/228
4,335,791 A * 6/1982 Evans ..... E21B 10/24 175/228
4,768,539 A * 9/1988 Pringle ..... E21B 34/02 137/458
5,320,182 A * 6/1994 Mendez ..... E21B 17/003 166/106
5,549,165 A * 8/1996 Brooks ..... E21B 33/1243 166/386
6,164,378 A * 12/2000 Coronado ..... E21B 33/127 166/187
6,220,079 B1 4/2001 Taylor et al.
6,293,346 B1 * 9/2001 Patel ..... E21B 41/00 166/373
6,325,153 B1 * 12/2001 Harrell ..... E21B 34/066 166/386
7,191,830 B2 * 3/2007 McVay ..... E21B 17/1078 166/242.1
8,080,498 B2 * 12/2011 Shepherd ..... E21B 41/00 166/250.07
8,347,969 B2 * 1/2013 Orr ..... E21B 33/00 166/373
8,967,272 B2 * 3/2015 Mock ..... E21B 41/0021 166/363
9,376,871 B2 * 6/2016 Levie ..... E21B 17/1042
9,404,317 B2 * 8/2016 Levie ..... E21B 17/1042
10,533,693 B2 * 1/2020 Dupont ..... F16N 17/00 175/228
2003/0089075 A1 * 5/2003 Oram ..... E21B 17/01 52/750
2003/0140673 A1 * 7/2003 Marr ..... B21D 39/10 72/58
2005/0189107 A1 9/2005 McVay et al.
2006/0243435 A1 * 11/2006 Faul ..... E21B 17/1078 166/241.1
2007/0175031 A1 8/2007 Pham et al.
2008/0217063 A1 * 9/2008 Moore ..... E21B 17/1042 175/57
2009/0126436 A1 5/2009 Fly et al.
2010/0122811 A1 * 5/2010 Maskos ..... E21B 17/1078 166/244.1
2013/0032354 A1 * 2/2013 Gerrard ..... E21B 34/101 166/373
2014/0110178 A1 * 4/2014 Savage ..... E21B 47/02 175/76
2014/0367085 A1 * 12/2014 Levie ..... E21B 17/1042 166/241.1
2015/0114621 A1 * 4/2015 Wood ..... E21B 41/00 166/180
2015/0354289 A1 * 12/2015 Carlsen ..... E21B 19/002 137/69

OTHER PUBLICATIONS

Kihwan Moon, International Preliminary Report on Patentability dated Sep. 26, 2019, PCT Application No. PCT/US2018/022299, pp. 1-7.
Extended European Search Report dated Oct. 28, 2020, EP Application No. 18768533, pp. 1-7.

* cited by examiner

EXPANSION CHAMBER

CROSS-REFERENCE TO RELATED APPLICATIONS

This application claims priority to U.S. Provisional patent application having Ser. No. 62/471,072, which was filed on Mar. 14, 2017. The entire contents of this provisional application are incorporated herein by reference.

BACKGROUND

During a production operation, fluid flows through production tubing from the oil and gas reservoirs. If the production tubing is in an isolated portion of the wellbore, the production tubing may expand radially outward, causing an increase in pressure in an annulus between the production tubing and the surrounding casing. As such, there is a need for a device that relieves the annular pressure in the isolated portion of the wellbore.

SUMMARY

Embodiments of the disclosure may provide an expansion chamber for use on a tubular. The expansion chamber includes a shell that is configured to be attached to the tubular by a bonding material, the shell having a port configured to receive the bonding material therethrough and into a cavity of the shell. The expansion chamber also includes a tube unit configured to be placed in the cavity of the shell, the tube unit having a tube with a port that is in fluid communication with the port of the shell.

Embodiments of the disclosure may also provide a method of relieving pressure in a wellbore. The method includes placing a shell of an expansion chamber on an exterior surface of a tubular, wherein a tube unit of the expansion chamber is positioned in a cavity formed in the shell, the cavity being substantially enclosed by the shell and the tubular. The method also includes securing the shell and the tube unit to the tubular by substantially filling an empty space of the cavity with a bonding material, deploying the tubular, including the shell and the tube unit into the wellbore, such that an annulus around the tubular is defined, and flowing a fluid through the tubular. Flowing the fluid through the tubular causes the tubular to expand, and the tubular expanding causes the tube unit to at least partially fill with fluid to at least partially avoid a pressure increase in the annulus.

Embodiments of the disclosure may further provide an expansion chamber for use on a tubular. The expansion chamber includes a shell that is configured to be attached to the tubular by a bonding material, the shell defining a cavity that is substantially enclosed when the shell is positioned on the tubular, an injection port configured to receive the bonding material therethrough and into the cavity, and a plurality of tube ports positioned through at least one axial face of the shell. The expansion chamber may also include a tube unit positioned at least partially in the cavity and comprising one or more tube assemblies, each tube assembly including a tube having a port configured to communicate with one of the plurality of tube ports, a piston positioned at least partially in the tube, and movable therein so as to vary a volume of the tube that is in communication with the one of the tube ports, and a piston chamber, the piston being received at least partially into the piston chamber, and the piston chamber being configured to resist movement of the piston in at least one direction with respect to the tube.

BRIEF DESCRIPTION OF THE DRAWINGS

The present disclosure may best be understood by referring to the following description and accompanying drawings that are used to illustrate embodiments of the invention. In the drawings.

DETAILED DESCRIPTION

Figure 1:
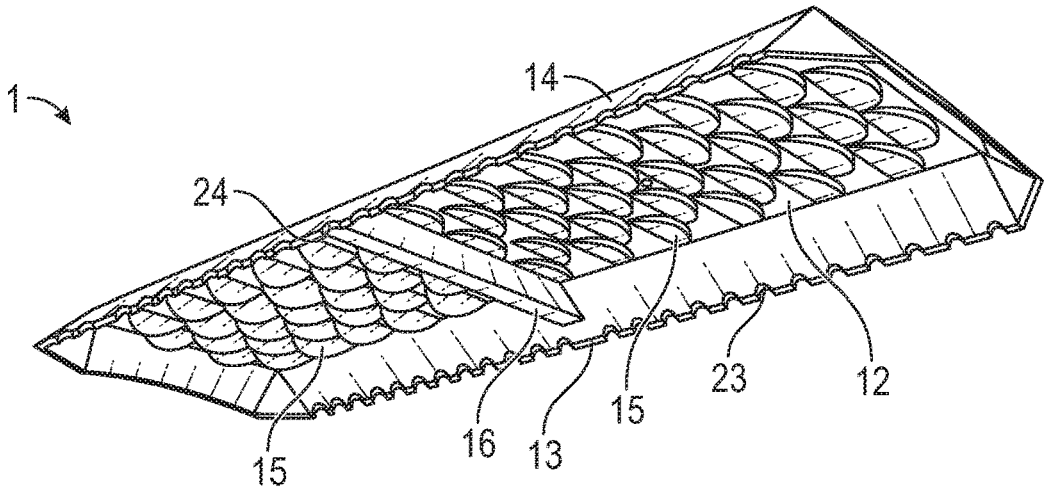
FIG. 1 (Prior Art)
FIG. 1 is a perspective view from below and to one side of a fiber reinforced composite shell body, according to an embodiment.

The following disclosure describes several embodiments for implementing different features, structures, or functions of the invention. Embodiments of components, arrangements, and configurations are described below to simplify the present disclosure, however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive, for example, the statement "A or B" should be considered to mean "A, B, or both A and B."

An expansion chamber may be applied to a tubular. As will be described herein, the expansion chamber may include an expansion chamber shell configured to a desired external shape and a tube unit. The external shape of the shell may be configured to form straight, curved, helical or spiral shaped positioning members, e.g., for maintaining a generally annular standoff between the tubular and a wellbore. The shell may have an external contact or bearing surface, which may be generally planar or outwardly curved (convex), with beveled side surfaces. The shell may have peripheral edges including portions adapted to allow passage of a flowable material. The peripheral edge portions may be indented, recessed, notched, serrated, apertured, crenulated, slotted or otherwise include a discontinuity which may form a flow port when the peripheral edge is presented against a parallel surface. The depth of the shell is selected to provide a clearance or spaced position from a surface such as the wall of a borehole.

In one embodiment, the interior surface of the shell may be configured to provide a plurality of projections, curved ridges, a fish scale pattern or any other relief pattern.

The shell may be structurally reinforced by provision of one or more strengthening members. The strengthening member may be a strut, brace, a rib or an equivalent thereof. Such structural reinforcement may extend between two opposite sides of the shell.

In one embodiment, the shell may be formed from a metallic material. In another embodiment, the shell may be formed from a composite material. The composite material may be a fiber-reinforced resin material (FRP/GRP/GFK type material). The resin material is a hardenable resin optionally including curing agents and curing modifiers. The resin may be self-curing, or provided in two components which harden when brought together. The two component system may be a matrix-forming (pre-polymer) component and a hardener. Suitable resins include epoxy resins, polyurethanes and polyurea resins including blends or hybrids thereof, and other curable resin components including polyester or polyol or polyamine components. The curing of the resin may be controlled by use of amine curing agents such as polyetheramines. Other additives may be present.

The fiber-reinforced resin material may be surface treated before molding of the shell. The fiber-reinforced resin material may have a ceramic particulate applied. The fiber-reinforced material may have a friction-modifying material applied. A combination of such surface treatments may be used. The surface treatment may be a surface modifying finish to an external surface of the molded shell.

Additional particulate materials may be present within the bulk of the fiber-reinforced resin material. The particulates may be in bead form.

The shell may have at least one inlet for passage of flowable materials, such as bonding agents. The shell may be bonded to an external surface of a tubular. Bonding agents may be introduced into a void between the tubular and the shell by injection through the at least one inlet.

The shell may be temporarily located upon a tubular, prior to introducing bonding agents into the shell, using temporary fastenings so as to enclose a void between the tubular and the shell. The temporary fastenings may be a contact adhesive or releasable fasteners which may include ties, wires, straps, an adhesive tape and various combinations thereof.

In an embodiment, a permanent mold or form is designed and constructed according to shape requirements for the shell form to be manufactured, that is, the geometry required for the intended positioning member. The shape requirements are derived from known dimensions of a tubular and its intended use in a wellbore. A choice can be made amongst protrusions of straight, curved or spiral or helical configurations. A number of differing molds may be produced to enable a variety of positioning members to be manufactured at will.

The mold is used to form materials into a prefabricated shell which is suitable to form part of a positioning member which is to be provide on a tubular.

In an embodiment, a fiber mat is infused with a resin matrix. This is achievable by passing the fiber mat through a bath containing the resin matrix. Infusion may also be achievable in other ways, such as applying the resin matrix liberally to the fiber mat by pouring or spraying or by a pressure treatment to soak, or impregnate the fiber mat with the resin matrix.

Ceramic particulates, for example hard wearing materials such as a combination of zirconium dioxide and silicon nitride, optionally in bead form, may be applied to the resin matrix infused fiber mat.

A friction modifying material such as fluorocarbon particulates providing a low friction coefficient also may be applied to the resin matrix infused mat.

The resin matrix infused fiber mat may be introduced to the mold such that surfaces treated with the aforesaid particulates are adjacent to the mold surfaces. Multiple additional layers of the resin matrix infused fiber mat, which may or may not each have been treated with particulates, may be laid up into the mold on to the first resin matrix infused fiber mat lining the mold until a predetermined thickness is attained.

Then the mold may be closed.

A resin filler matrix may be introduced into the mold using a low pressure resin transfer molding process. In an example of such a process, a mixed resin and catalyst or resin curing agent are introduced, for example by injection, into a closed mold containing a resin matrix infused fiber and particulates lay up. In this way a composite shell may be formed.

The mold may be heated in order to achieve first cure.

After sufficient curing of the resin to permit handling of the shell, the mold can be opened and the formed shell removed.

If necessary a post cure of the formed shell may be carried out. Post cure may be a heat treatment, for example conducted in an oven.

In at least some embodiments, the shell may be formed using one or more embodiments of the shell-forming process discussed in U.S. Pat. No. 9,376,871, which is incorporated herein by reference to the extent not inconsistent with the present disclosure.

Figure 2:
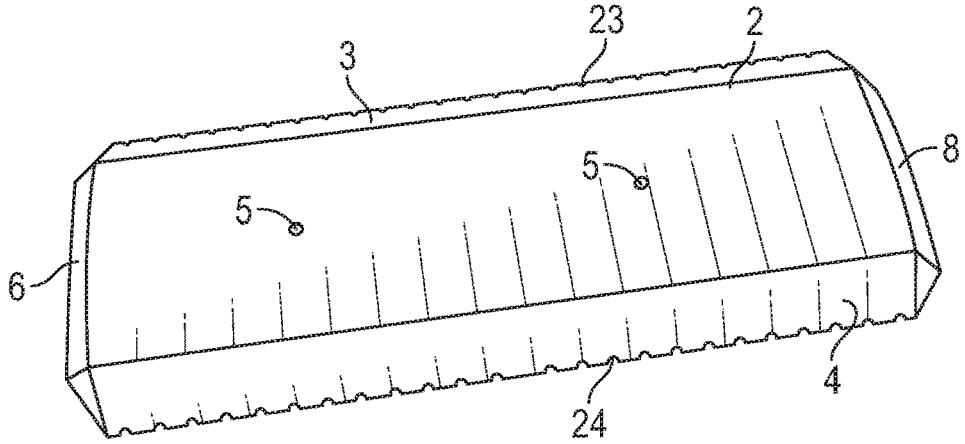
FIG. 2 (Prior Art)
FIG. 2 is a perspective view form above and to one side of a fiber reinforced composite shell body, according to an embodiment.
Figure 3:
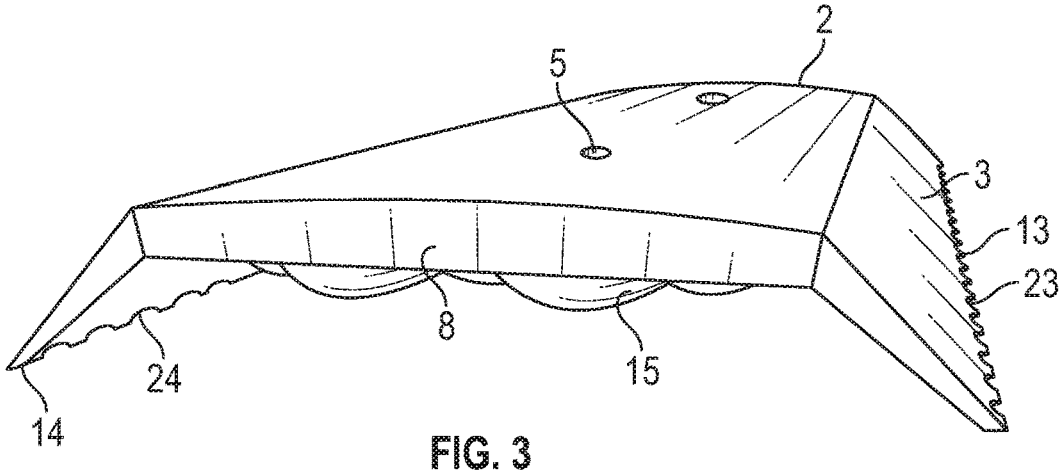
FIG. 3 (Prior Art)
FIG. 3 is a perspective view from one end of a fiber reinforced composite shell body, according to an embodiment.

Turning now to the illustrated embodiments, FIGS. 1-3 illustrate several views of a shell 1 with an outer contact or bearing surface 2 which is generally planar with peripheral sloping or beveled sides 3, 4 and ends 6, 8. Other embodiments may have a convex curved bearing surface or faceted contour surface. The outer bearing surface 2 is provided with injection inlet ports 5.

Referring to FIG. 1, the shell 1 has peripheral edges 13, 14 adapted to allow passage of a flowable material. For example, recesses 23, 24 may be provided along portions of the peripheral edges 13, 14, resulting in a series of apertures when the peripheral edges 13, 14 are in contact with a parallel surface. Such apertures may allow for the passage of the flowable material.

Additionally, an inner surface 12 of the shell 1 is configured to provide a plurality of curved ridges 15, or fish scale pattern, to provide a keying surface to improve adhesion or bonding with a bonding material.

Optionally, the shell 1 may be formed to include structural reinforcements such as one or more integral strengthening struts, braces, or ribs 16 extending from one side 3 to an opposite side 4. One such transverse strut 16 is shown in FIG. 1.

In use of the shell 1 to form a positioning member, a selected outer surface area of a tubular 10 is prepared in order to provide a clean, dry substrate with an appropriate surface profile for receiving the shell.

Figure 4:
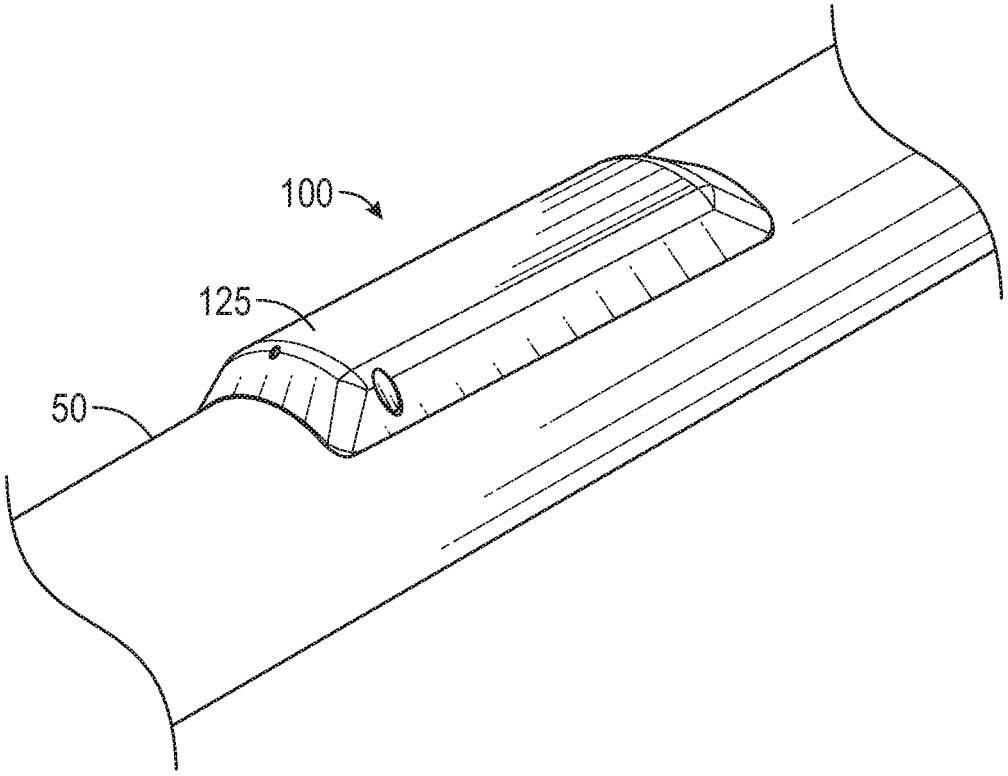
FIG. 4 is a perspective view of an expansion chamber attached to a tubular, according to an embodiment.

FIG. 4 is a perspective view of an expansion chamber 100 attached to a tubular 50, according to an embodiment. The expansion chamber 100 includes an expansion chamber shell 125 and a tube unit (not shown). During the installation process, the expansion chamber 100 of appropriate dimensions is presented to the prepared area, so that the edges are contiguous with the surface of the tubular 50. The expansion chamber 100 may be held in position temporarily by use of releasable fastenings such as removable straps, or adhesive tape. A cavity is thereby defined between interior surfaces of the expansion chamber 100 and the prepared area of the tubular 50.

Figure 5:
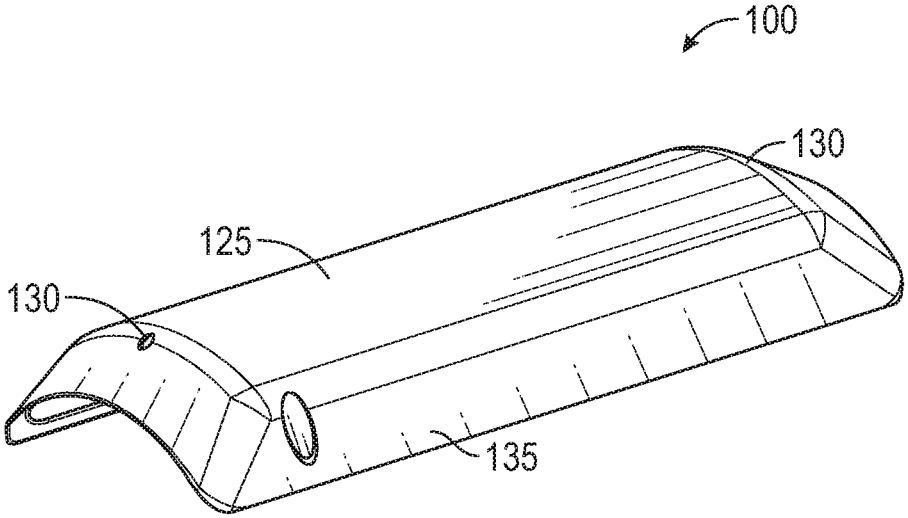
FIG. 5 is a perspective view of the expansion chamber, according to an embodiment.

FIG. 5 is a perspective view of the expansion chamber 100. The expansion chamber shell 125 may be configured and made in a similar manner as the shell 1. As shown, the shell 125 includes ports 130. After the expansion chamber 100 is placed on the tubular 50 (FIG. 4), a bonding material is injected into the shell cavity through one or more of the ports 130 in the surface of the shell 125 until it flows through the apertures defined between the recesses and the surface of the tubular 50. In one embodiment, suction may be applied to the ports 130, so as to evacuate air from the cavity during or prior to injection of the bonding material. In other embodiments, the injection of the bonding material itself may force air, or any other gases or fluids out of the ports 130, without requiring an externally-generated pressure differential (e.g., suction) to be applied to the ports. When a period sufficient for curing of the bonding material has elapsed, the straps and/or adhesive tape may be removed. Additional expansion chambers 100 may be formed on the tubular 50 by repetition of the above described methods and procedures.

Figure 6:
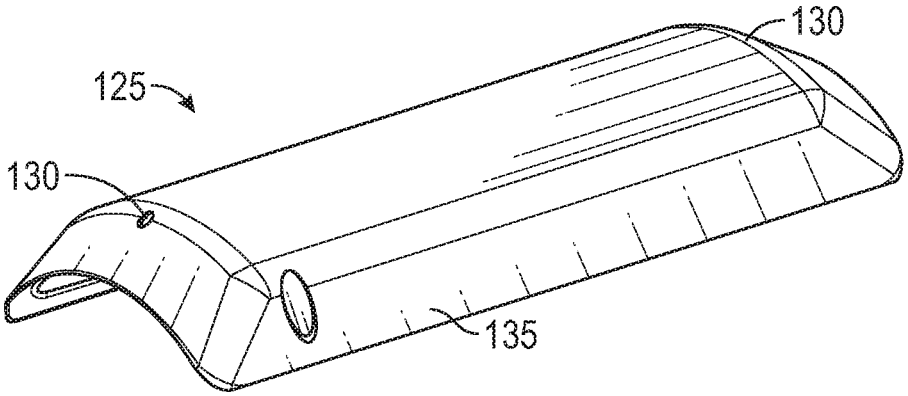
FIG. 6 is a perspective view of a shell of the expansion chamber, according to an embodiment.
Figure 7:
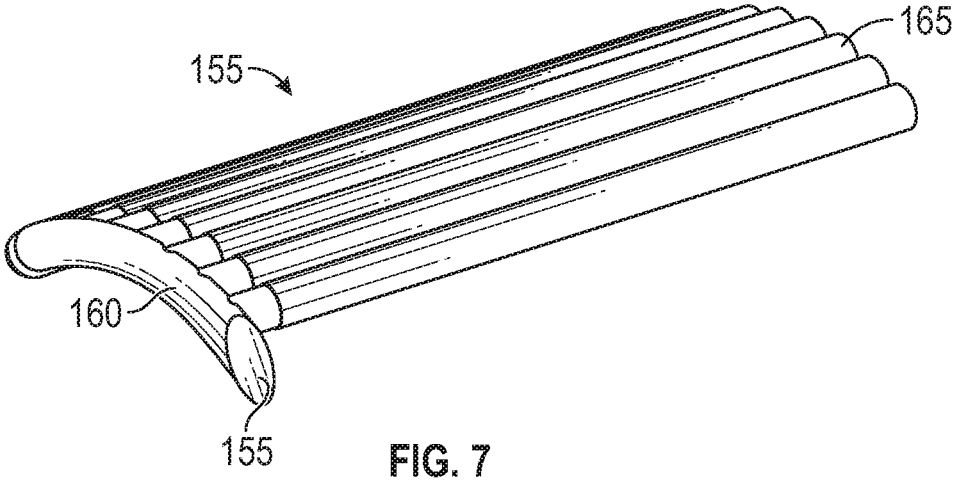
FIG. 7 is a perspective view of a tube unit of the expansion chamber, according to an embodiment.
Figure 8:
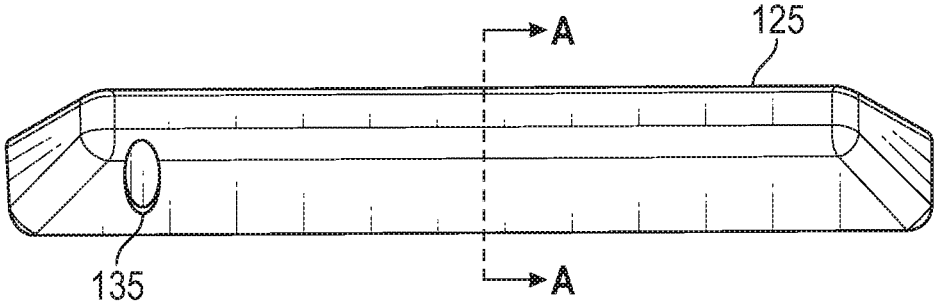
FIG. 8 is a side view of the expansion chamber, according to an embodiment.
Figure 9:
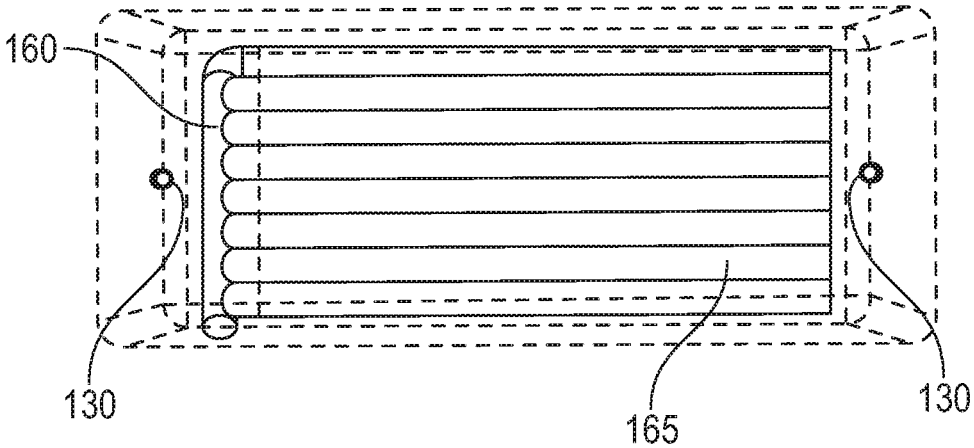
FIG. 9 is a bottom view of the expansion chamber, according to an embodiment.
Figure 10:
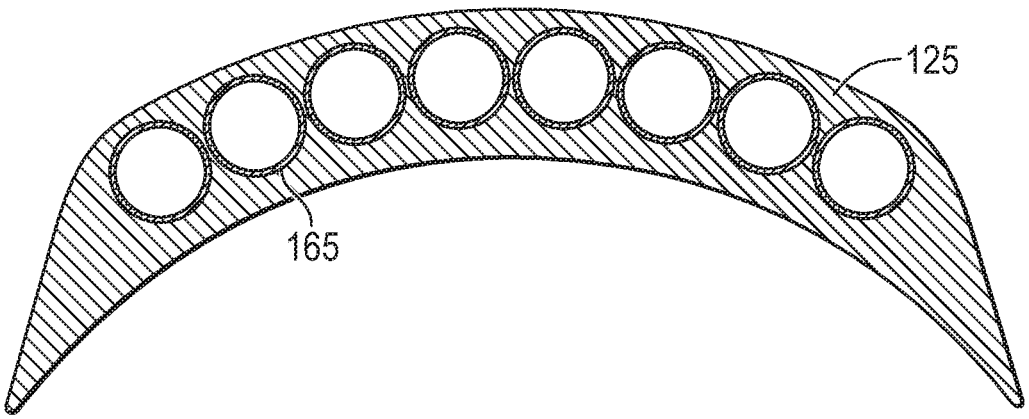
FIG. 10 a sectional view along line A-A of FIG. 8, according to an embodiment.

FIG. 6 is a perspective view of the shell 125 of the expansion chamber 100. As shown, the shell 125 includes injection ports 130 and a side port 135. FIG. 7 is a perspective view of a tube unit 150 of the expansion chamber 100. The side port 135 in the shell 125 is in fluid communication with a port 155 of the tube unit 150. The tube unit 150 includes a plurality of tubes 165 connected with a manifold 160. In one embodiment, a rupture disk (not shown) may be placed proximate the port 155. The rupture disk is configured to rupture at a predetermined pressure to allow fluid into the port 155 and subsequently into the tubes 165. FIGS. 8-10 are various views of the expansion chamber 100.

In operation, the tubular 50 and the expansion chamber 100 are lowered into the wellbore. A packer or another isolation device may be used to isolate a portion of the wellbore having the tubular 50 and the expansion chamber 100, such that a closed annular area is created between an outside of the tubular 50 and the surrounding casing in the wellbore. During a production operation, the tubular 50 may expand (i.e., outer diameter of the tubular becomes larger) when production fluid flows through the tubular 50. The outward radial expansion of the tubular 50 may be due to a temperature difference between the fluid moving through the tubular 50 and the fluid in the surrounding area. As a result of the expansion of the tubular 50, fluid in the closed annular area (between the tubular and surrounding casing) may become compressed. The expansion chamber 100 is configured to provide pressure control in the casing. In other words, the expansion chamber 100 is configured to minimize (or reduce) the annular pressure in the closed annular area by allowing fluid to flow into the ports 135, 155, the manifold 160 and subsequently into the tubes 165. The tubes 165 are configured to hold a large amount of fluid. Over time the flow of production fluid through the tubular 50 may be reduced which may cause the tubular 50 to retract (i.e., outer diameter of the tubular becomes smaller) and as a result the fluid in the closed annular area (between the tubular and surrounding casing) may become decompressed. The fluid in the tubes 165 may be allowed to exit the ports 135, 155 into the closed annular area. The process of filling the expansion chamber 100 and empting the expansion chamber 100 may occur any number of times. Further, multiple of expansion chambers 100 may be disposed in the closed annular area which will allow a substantial amount of fluid to be removed from the closed annular area (by filling the expansion chambers). In one embodiment, the tubes 165 in the tube unit 150 may be filled with a compressible media, such as a gas, which may compress when fluid enters the expansion chamber 100 and then expand when fluid exits the expansion chamber 100. The compression media may aid in expelling fluid from the tubes 165 when the tubular 50 retracts.

Figure 11:
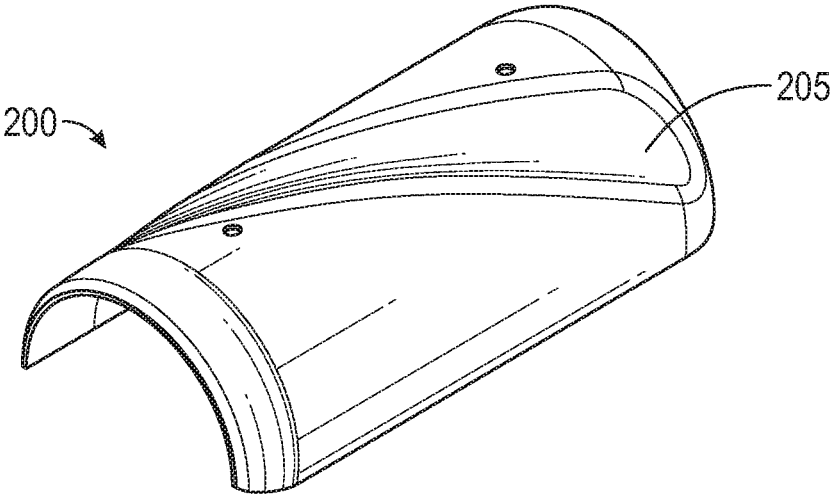
FIG. 11 is a perspective view of an expansion chamber, according to an embodiment.
Figure 12:
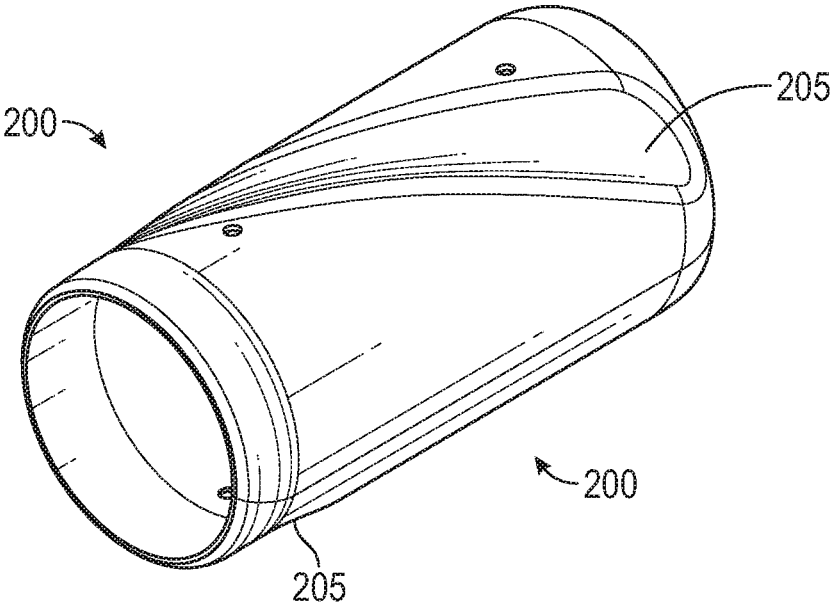
FIG. 12 is a view of the expansion chamber of FIG. 11, according to an embodiment.
Figure 13:
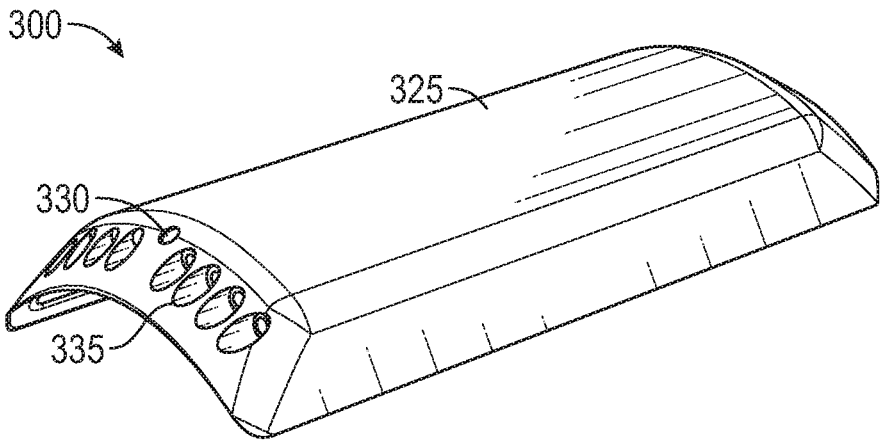
FIG. 13 is a perspective view of an expansion chamber, according to an embodiment.
Figure 14:
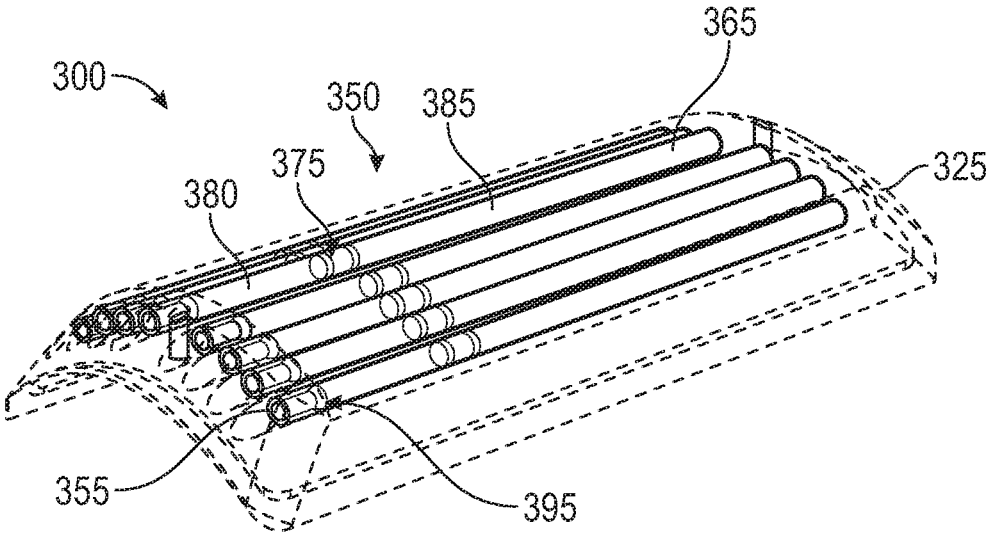
FIG. 14 is a view of the expansion chamber, according to an embodiment.
Figure 15:
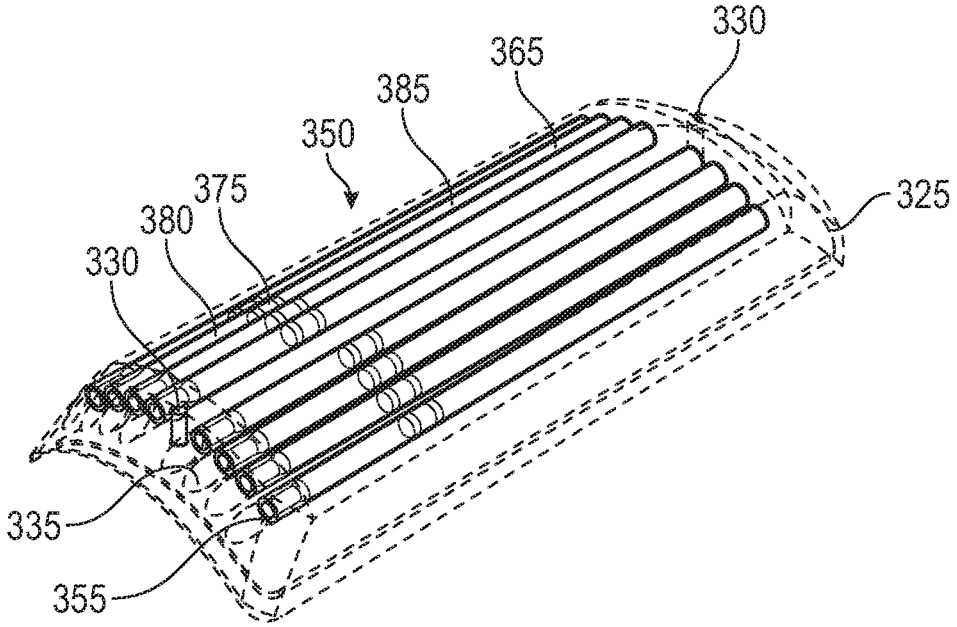
FIG. 15 is a perspective view of the expansion chamber, according to an embodiment.
Figure 16:
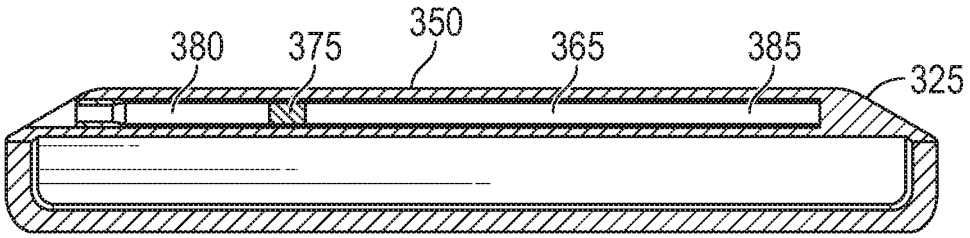
FIG. 16 is a side view of the expansion chamber, according to an embodiment.
Figure 17:
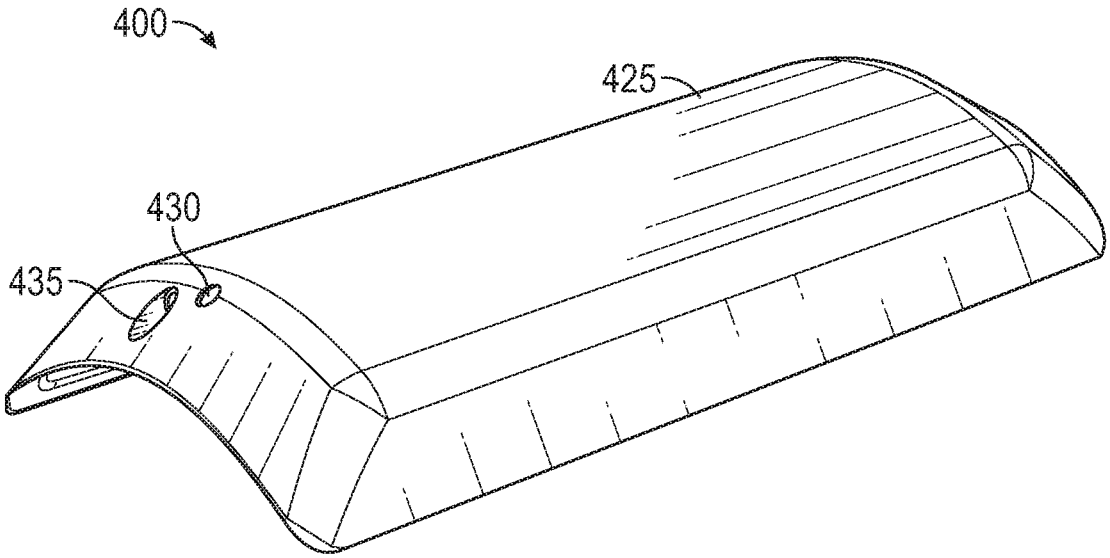
FIG. 17 is a perspective view of an expansion chamber, according to an embodiment.
Figure 18:
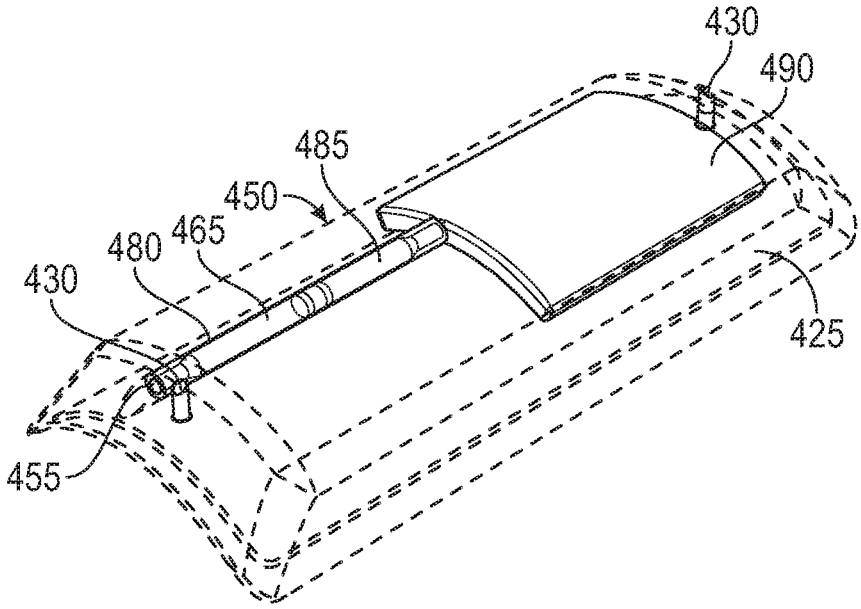
FIG. 18 is a view of the expansion chamber, according to an embodiment.
Figure 19:
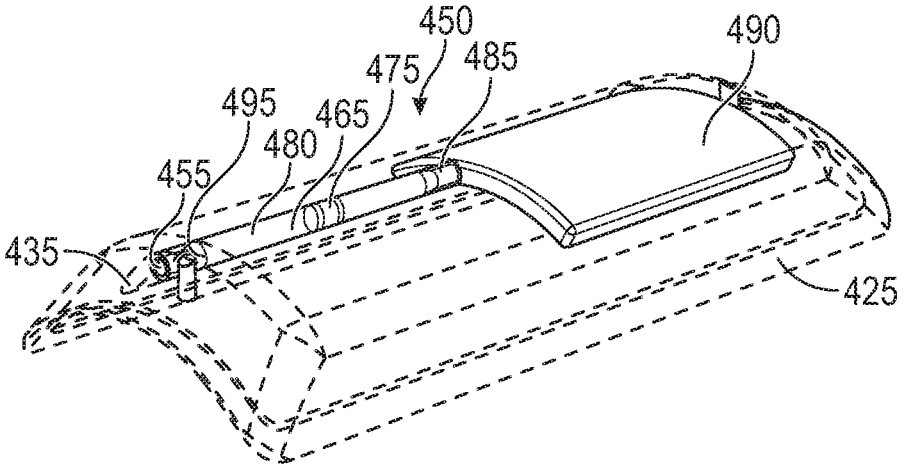
FIG. 19 is a perspective view of the expansion chamber, according to an embodiment.
Figure 20:
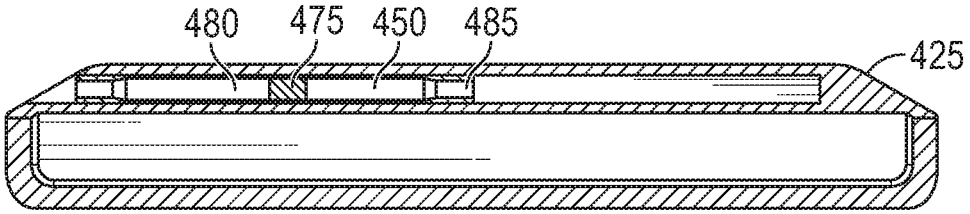
FIG. 20 is a side view of the expansion chamber, according to an embodiment.

FIGS. 11 and 12 are perspective views of an expansion chamber 200, according to an embodiment. The expansion chamber 200 includes all the components in expansion chamber 100. In addition, the expansion chamber 200 includes a flow channel 205 on an outer surface of the shell 125. The flow channel 205 is configured to allow fluid to flow past the expansion chamber 200. When two expansion chambers 200 are placed around the circumference of the tubular as shown in FIG. 12 the fluid is allowed to move past the expansion chambers 200 and into the tube unit (not shown).

FIGS. 13-16 are views of an expansion chamber 300, according to an embodiment. The expansion chamber 300 includes an expansion chamber shell 325 and a tube unit 350. During the installation process, the expansion chamber 300 of appropriate dimensions is presented to the prepared area, so that the edges are contiguous with the surface of the tubular (not shown). The expansion chamber 300 may be held in position temporarily by use of releasable fastenings such as removable straps, or adhesive tape. A cavity is thereby defined between interior surfaces of the expansion chamber 300 and the prepared area of the tubular.

The expansion chamber shell 325 may be configured and made in a similar manner as the shell 1. As shown, the shell 325 includes injection ports 330. After the expansion chamber 300 is placed on the tubular, a bonding material is injected into the shell cavity through one or more ports 330 in the surface of the shell 325, e.g., until the bonding material substantially fills the cavity, which may be apparent, for example, when the bonding material flows through the apertures defined between the recesses and the surface of the tubular. In one embodiment, suction may be applied to the ports 330, so as to evacuate air from the cavity during or prior to injection of the bonding material. In other embodiments, the injection of the bonding material itself may force air, or any other gases or fluids out of the ports 330, without requiring an externally-generated pressure differential (e.g., suction) to be applied to the ports. When a period sufficient for curing of the bonding material has elapsed, the straps and/or adhesive tape may be removed. Additional expansion chambers 200 may be formed on the tubular by repetition of the above described methods and procedures.

As shown, the shell 325 includes a front port 335 in fluid communication with a port 355 of a tube 365. Further, each front port 335 may include a rupture disk placed proximate an end of the port 355. The rupture disk is configured to rupture at a predetermined pressure to allow fluid into the port 355 and subsequently into the tube 365. Each tube 365 may include an end restriction 395. Each tube 365 may include a piston 375 that separates a first portion 380 of the tube 365 from a second portion 385 of the tube 365. The piston 375 is configured to move along an inner surface of the tube 365 when fluid enters or exits the first portion 380 of the tube 365. In one embodiment, the piston 375 is made from an elastomer material, a composite material or a combination thereof. The second portion 385 of the tube 365 may include a compressible media, such as a gas or a biasing member, such as a spring. The media or biasing member is configured compress when fluid enters the tube 365 and the media or biasing member is configured expand when fluid exits the tube 365.

FIGS. 17-20 are views of an expansion chamber 400, according to an embodiment. The expansion chamber 400 includes an expansion chamber shell 425 and a tube unit 450. During the installation process, the expansion chamber 400 of appropriate dimensions is presented to the prepared area, so that the edges are contiguous with the surface of the tubular (not shown). The expansion chamber 400 may be held in position temporarily by use of releasable fastenings such as removable straps, or adhesive tape. A cavity is thereby defined between interior surfaces of the expansion chamber 400 and the prepared area of the tubular. The expansion chamber shell 425 may be configured and made in a similar manner as the shell 1. In a similar manner as described in the embodiment for the expansion chamber 300, a bonding material is injected into the shell cavity through one or more inlet ports 430 in the surface of the shell 425 to attach the expansion chamber 400 to the tubular.

As shown, the shell 425 includes a front port 435 in fluid communication with a port 455 of a tube 465. The tube 465 may be connected to a chamber 490. Further, a rupture disk placed proximate an end of the port 435. The rupture disk 15 is configured to rupture at a predetermined pressure to allow fluid into the port 455 and subsequently into the tube 465. Each tube 465 may include an end restriction 495. Each tube 465 may include a piston 475 that separates a first portion 480 of the tube 465 from a second portion 485 of the tube 465. The piston 475 is configured to move along an inner surface of the tube 465 when fluid enters or exits the first portion 480 of the tube 465. In one embodiment, the piston 475 is made from an elastomer material, a composite material or a combination thereof. The second portion 485 of the tube 465 and the chamber 490 may include a compressible media, such as a gas or a biasing member, such as a spring. The media or biasing member is configured compress when fluid enters the tube 465 and the media or biasing member is configured expand when fluid exits the tube 465.

In operation, the tubular and the expansion chamber 300, 400 are lowered into the wellbore. A packer or another isolation device may be used to isolate a portion of the wellbore having the tubular and the expansion chamber 300, 400, such that a closed annular area is created between an outside of the tubular and the surrounding casing in the wellbore. During a production operation, the tubular may expand (i.e., outer diameter of the tubular becomes larger) when production fluid flows through the tubular. The outward radial expansion of the tubular may be due to a temperature difference between the fluid moving through the tubular and the fluid in the surrounding area. As a result of the expansion of the tubular, fluid in the closed annular area (between the tubular and surrounding casing) may become compressed. The expansion chamber 300, 400 is configured to provide pressure control in the casing. In other words, the expansion chamber 300, 400 is configured to minimize (or reduce) the annular pressure in the closed annular area by allowing fluid to flow into the ports and subsequently into the tubes 365, 465 which in turns moves the piston 375, 475 in the tubes 365, 465 and compress the media or biasing member. The tubes 365, 465 are configured to hold a large amount of fluid. Over time the flow of production fluid through the tubular may be reduced which may cause the tubular to retract (i.e., outer diameter of the tubular becomes smaller) and as a result the fluid in the closed annular area (between the tubular and surrounding casing) may become decompressed. At that point, the compressed media or biasing member expands and urges the piston 375, 475 in the tubes 365, 465 to expel the fluid in the tubes 365, 465 into the closed annular area. The process of filling the expansion chamber 300, 400 and empting the expansion chamber 300, 400 may occur any number of times. Further, multiple of expansion chambers 300, 400 may be disposed in the closed annular area which will allow a substantial amount of fluid to be removed from the closed annular area (by filling the expansion chambers).

Figure 21:
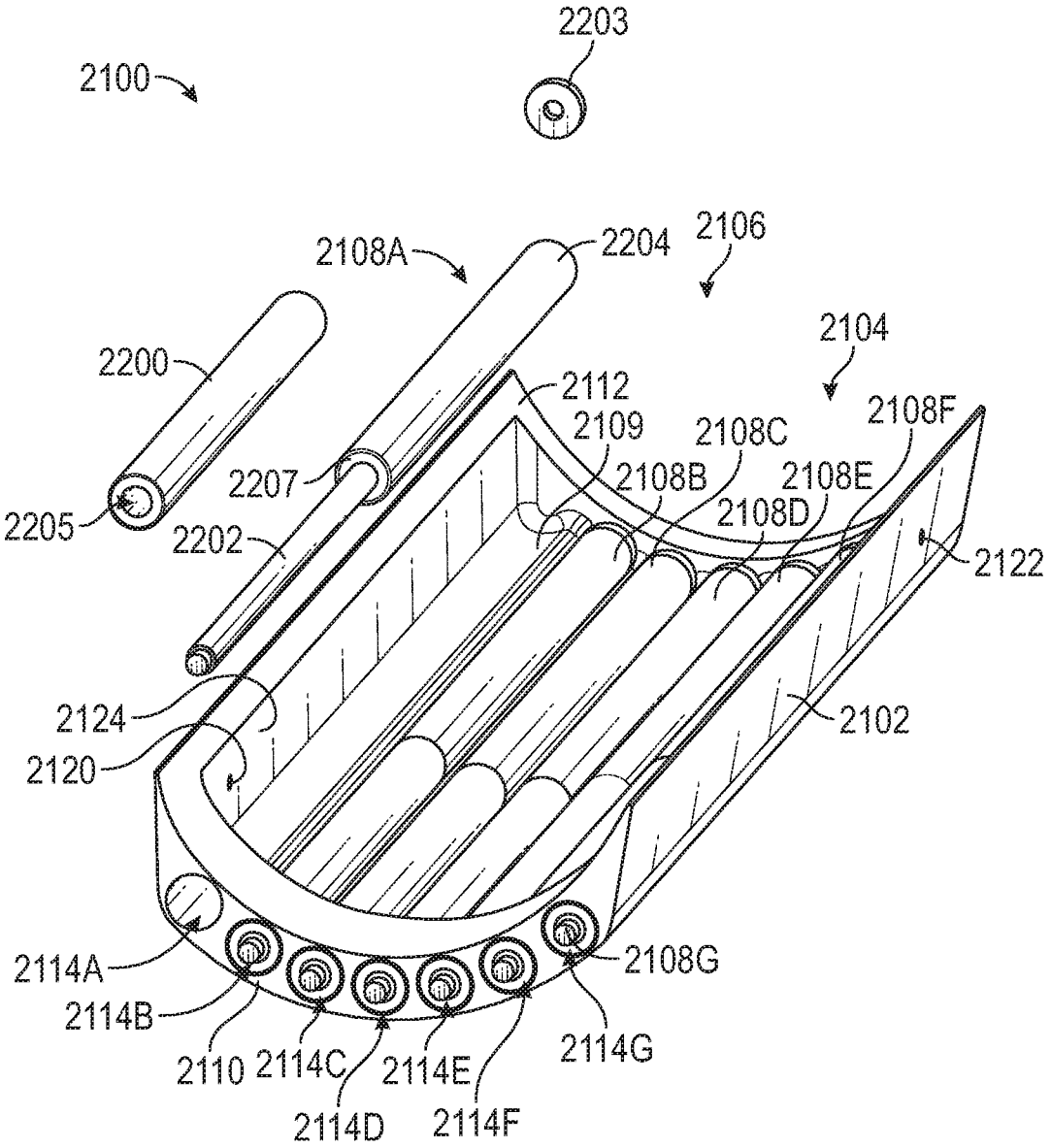
FIG. 21 is a partially-exploded view of a cavity-side of an expansion chamber, prior to be installed on the tubular, according to an embodiment.

FIG. 21 illustrates a partially-exploded, perspective view of another expansion chamber 2100, according to an embodiment. In particular, this view illustrates the "underside" of a shell 2102 of the expansion chamber 2100, showing a cavity 2104 thereof. The shell 2102 may be fabricated prior to application thereof to a tubular ("prefabricated"), in a manner that is the same as or similar to the shell 1 shown in and discussed above with reference to FIGS. 1-3. Once applied and fixed to the tubular, the expansion chamber 2100 may be run into a wellbore along with the tubular, for positioning in an enclosed (e.g., annular) volume between the tubular and a surrounding tubular (e.g., casing, liner, or the wellbore wall in an uncased hole), as will be described in greater detail below. In some embodiments, the shell 2102 may be arcuate in cross-section, such that it extends only partially around the tubular, when connected thereto.

The expansion chamber 2100 may include a tube unit 2106, which may be made of one or more longitudinally-extending tube assemblies (seven are shown: 2108A-G). The tube assemblies 2108A-G may be configured to provide a variable volume for the enclosed volume external to the shell 2102. This may at least partially avoid (e.g., mitigate) pressure fluctuations, or at least pressure increases, experienced outside of the shell 2102, in the enclosed volume, e.g., due to the tubular expanding, as explained above.

The shell 2102 may include axial end faces 2110, 2112, which may be oriented uphole and downhole, with either being suitable for either direction in various embodiments. In an embodiment, one or more tube ports (seven are shown: 2114A-G) may be formed in one of the axial end faces 2110, e.g., one for each tube 2108A-G. In some embodiments, the tube ports 2114A-G may not all be formed on the same axial end face 2110; rather, some or even all may be formed on the opposite axial end face 2112. Each tube assembly 2108A-G may be provided with a corresponding tube port 2114A-G in one axial end face (e.g., the axial end face 2110), and may bear against the opposite axial end face (e.g., the axial end face 2112). The individual tube assemblies 2108A-G may be positioned so as to communicate with the exterior of the shell 2102 via the tube ports 2114A-G. In some embodiments, the individual tube assemblies 2108A-G may extend partially through the respective tube ports 2114A-G, as shown.

In some embodiments, the shell 2102 may define profiles 2109 for receiving at least a portion of the outer surface of the individual tube assemblies 2108A-G. As shown, the profiles 2109 may take the form of arcuate contours that the individual tube assemblies 2108A-G may be received into during assembly with the shell 2102. The profiles 2109 may be open-ended, rather than bores enclosed in the shell 2102, allowing for the tubular assemblies 2108A-G to be exposed to the cavity 2104, and secured therein via bonding, as will be described below. In other embodiments, the profiles 2109 may be enclosed bores, and the tube assemblies 2108A-G may be secured therein.

The shell 2102 may also define one or more injection ports (two are shown: 2120, 2122), which may be formed through the shell 2102, e.g., radially. The injection ports 2120, 2122 may be positioned generally proximal to the opposite axial end faces 2110, 2112, respectively, and may be circumferentially offset from one another. In other embodiments, the ports 2120, 2122 may be circumferentially aligned, e.g., proximal to the longitudinal centerline of the shell 2102. In various embodiments, the ports 2120, 2122 may be positioned anywhere that is suitable for injecting bonding material. For example, the ports 2120, 2122 may be positioned between adjacent tubes 2200 or between the tube 2200 of one of the end tube assemblies (e.g., tube assembly 2108A) and a sidewall 2124 of the shell 2102. As such, bonding material may be injected through the shell 2102, into the cavity 2104, and fill the empty space in the cavity 2104 between the tube assemblies 2108A-G, as will be described in greater detail below.

The components of the tube assembly 2108A will now be described herein by way of example, with it being appreciated that the remaining tube assemblies 2108B-G may be substantially the same in at least some embodiments. Accordingly, in an embodiment, the tube assembly 2108A may include a tube 2200, a piston 2202, and a piston chamber 2204. In some embodiments, the tube assembly 2108A may also include an annular or disk-shaped spacer 2203, but in other embodiments may omit the spacer 2203. When provided, the spacer 2203 may allow the combination of the tube 2200 and the piston chamber 2204 to be made slightly longitudinally shorter than the available length of the cavity 2104, thereby facilitating sliding the tube assembly 2108A into the place in the shell 2102. Once the rest of the tube assembly 2108A is in place, the spacer 2203 may be fit snugly between the axial end 2112 of the shell 2102 and the piston chamber 2204, to secure the tube assembly 2108A in place in the cavity 2104.

The tube 2200 may be generally hollow, defining a port 2205 that is in communication with the corresponding tube port 2114A in the shell 2102. The piston 2202 may fit within the tube 2200, e.g., forming a seal with the inner diameter thereof. The hollow tube 2200 may communicate with the corresponding tube port 2114A. The tube 2200 may also fit against an end 2207 of the piston chamber 2204, but in other embodiments, may extend around the piston chamber 2204. In a fully extended state, the piston 2202 may have one end that extends through the port 2205 of the tube 2200 and, in some embodiments, into the tube port 2114A, thereby blocking the interior of the tube 2200 from communicating with the exterior of the shell 2102 via the tube port 2114A and the port 2205. The piston 2202 may, however, be depressible, such that the piston 2202 can be forced at least partially into the piston chamber 2204, e.g., in response to application of a predetermined pressure exterior to the shell 2102. The position of the piston 2202 relative to the tube 2200 may determine the amount of volume in the tube 2200 that communicates with the exterior of the shell 2102.

In some embodiments, the piston chamber 2204 may be a cylinder that is enclosed around the piston 2202. Within the piston chamber 2204, the piston chamber 2204 may provide a biasing element, e.g., a compressible medium. To name two specific, non-exclusive examples, the piston chamber 2204 may contain a spring or a gas (e.g., Nitrogen) charge. Accordingly, the piston chamber 2204 may resist movement of the piston 2202 from the uncompressed state, as such movement may proceed by increasing the pressure of the gas charge, compressing the spring, or both (or in any other suitable fashion using other biasing elements). Further, the resistance force may increase as the piston 2202 is depressed into the piston chamber 2204. The amount of force required to move the piston 2202 into the piston chamber 2204 may be configurable by selection of a spring with an appropriate size or stiffness, by changing the pressure of the gas charge in the piston chamber 2204, or both. As such, the expansion chamber 2100 may be tailored for use in applications across a wide range of pressures.

In another embodiment, the piston 2202 may instead be a tubular extension of the piston chamber 2204, and may be stationary with respect thereto. In such an embodiment, a piston may be movable within the chamber 2204, and the chamber 2204 may be in communication with the tube port 2205 via the tubular extension 2202. Movement of the piston in the chamber 2204 may vary the volume that is accessible to the fluid in the enclosed volume (e.g., annulus) surrounding the expansion chamber 2100.

As mentioned previously, in some situations, a frangible (or disintegrating) rupture disk may also be employed to control the application of pressure to the tube unit 2106. For example, such a rupture disk may be placed across the tube ports 2114A-G, or in the tube 2200 of each of the tube assemblies 2108A-G, e.g., between the piston 2202 and the respective ports 2205.

The tube 2200, piston 2202, and piston chamber 2204 may each be a metal or alloy, such as stainless steel or a composite material (e.g., glass-reinforced polymer or carbon fiber). The tube 2200, piston 2202, and piston chamber 2204 may be made from the same material, but in other embodiments, may be made from different materials. The spacer 2203 may also be metal, a metal alloy, a composite material, elastomer, or a polymer.

To fix the expansion chamber 2100 to a tubular, the expansion chamber 2100 may be placed on an exterior surface of the tubular, with the cavity 2101 being between the shell 2102 and the tubular, such that the cavity 2101 is substantially enclosed by the shell 2102 and the tubular. The tube unit 2106 may already be positioned within the cavity 2101 at this point. Next, a bonding material may be injected into the cavity 2104, e.g., via the injection port 2120 formed through the shell 2102. In some embodiments, a vacuum may be applied to the injection port 2122, to facilitate filling the cavity 2104 with the bonding material. As will be appreciated, when injected, the bonding material may thus at least partially envelope or surround the tube assemblies 2108A-G, securing the piston chamber 2204 and the tube 2200 in place. The piston 2202, being positioned within the tube 2200 and the piston chamber 2204 may remain free to slide with respect thereto, as mentioned above, since the bonding material is prevented from contacting, and thus adhering, thereto. The bonding material may then cure, securing the shell 2102 to the tubular, along with the tube unit 2106.

In use, the interior of the tube 2200 may provide increased volume for the fluids in the enclosed volume exterior to the shell 2102 to occupy. Thus, for example, as pressure in the enclosed volume increases, the fluid pressure may depress the piston 2202 into the piston chamber 2204, allowing for the fluid to occupy at least a portion of the interior of the tube 2200, thereby at least partially avoiding (e.g., mitigating or entirely avoiding) pressure increases in the annulus due to expansion of the tubular to which the expansion chamber 2100 is attached.

In some situations, one or more of the tube assemblies 2018A-G may be unnecessary, as the extra volume provided thereby might not be needed. Thus, one or more of the tube assemblies 2108A-G may be omitted prior to assembly of the expansion chamber 2100 and attachment thereof to the tubular. Further, in such situation, the tube port(s) 2114A-G corresponding to the omitted tube assembly(ies) may not be drilled, or, if present, may be plugged. As such, the bonding material may fill the volume wherein the omitted tube assembly(ies) 2108A-G would have been positioned.

One benefit of the expansion chamber 100, 200, 300, 400, 2100 is that the expansion chamber may be bonded directly to the tubular centralization device. Another benefit is that the expansion chamber may have a staggered placement to give enhanced fluid bypass and ECD. A further benefit of the expansion chamber is that it is has a very low friction coefficient. An additional benefit of the expansion chamber is that it has lower impact geometry for wellbore restrictions/obstructions. A further benefit of the expansion chamber is the flexibility of design for bespoke solutions. In addition, a benefit of the expansion chamber is that it has a very robust construction and high mechanical properties. In one embodiment, the tube unit in the expansion chamber may be manufactured from thin-walled carbon fiber tubes. In another embodiment, the shell of the expansion chamber may be made from a fiber material, a metallic material or a combination thereof, such as a metal matrix composite.

Figure 22:
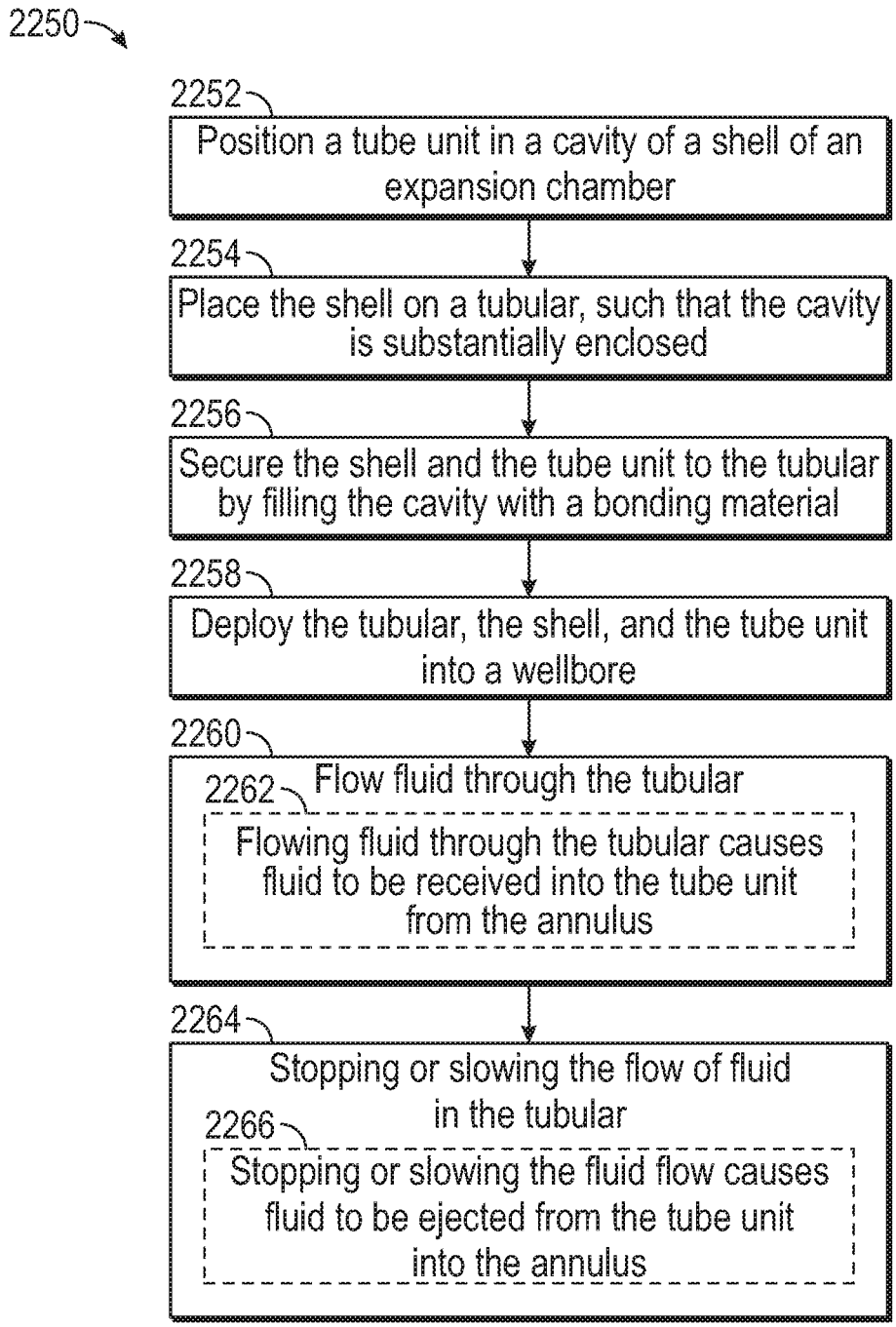
FIG. 22 is a flowchart of a method of relieving pressure in a wellbore, according to an embodiment.

FIG. 22 illustrates a flowchart of a method 2250 of relieving annular pressure in a wellbore, according to an embodiment. The method 2250 may proceed by operation of one or more embodiments of the expansion chambers discussed above. For the sake of convenience, reference is made to the embodiment of the expansion chamber 2100 shown in and described above with reference to FIG. 21, but it will be appreciated that embodiments of the method 2250 may apply to the other described embodiments, or even other types of structures.

The method 2250 may include positioning a tube unit 2106 in a cavity 2104 of a shell 2102 of an expansion chamber 2100, as at 2252. With the tube unit 2106 in place, the method 2250 may proceed to placing the shell 2102 on an exterior surface of a tubular, as at 2254. The shell 2102 may be temporarily secured to the tubular, e.g., using straps, clamps, adhesive, etc., generally to maintain the position of the shell 2102 in preparation for the expansion chamber 2100 being more permanently installed on the tubular. In some embodiments, the shell 2102 may be prefabricated, prior to placing the tube unit 2106 therein and/or prior to placing the shell 2102 on the tubular.

The method 2250 may include securing the shell 2102 and the tube unit 2106 to the tubular by substantially filling an empty space of the cavity 2104 with a bonding material, as at 2256. Securing the shell 2102 may, in some embodiments, occur after placing the tube unit 2106 into the shell 2102. In an embodiment, securing at 2256 includes injecting the bonding material into the cavity 2104 through the shell 2102, such that the tube unit is at least partially enveloped by the bonding material, and allowing the bonding material to cure, thereby fixing the shell 2102 to the tubular. For example, injecting the bonding material may include injecting the bonding material through one or more injection ports 2120, 2122 formed in the shell 2102. Furthermore, injecting the bonding material may include preventing the bonding material from bonding to a movable piston 2202 of the tube unit 2160, e.g., by containing the piston 2202 within the tube 2200 and/or the piston chamber 2204.

The method 2250 may also include deploying the tubular, including the shell 2102, the tube unit 2106, and the bonding material into the wellbore, as at 2258. The tubular and the wellbore (e.g., a liner, casing, or wellbore wall thereof) may together define an annulus therebetween, which may be isolated, e.g., between two packers, so as to form an enclosed volume.

The method 2250 may include flowing a fluid through the tubular, as at 2260. As indicated at 2262, flowing the fluid through the tubular causes the tubular to expand, and the tubular expanding causes the tube unit 2106 to at least partially fill with fluid, thereby increasing a volume available for the fluid in the fluid in the annulus to occupy, and at least partially avoiding a pressure increase in the annulus. In an embodiment, flowing the fluid through the tubular causes a rupture disk of the expansion chamber to break, thereby allowing fluid to communicate with a port in the shell, the port in communication with a tube of the tube unit.

The method 2250 may further include stopping or slowing fluid flow through the tubular, as at 2264. As indicated at 2266, stopping or slowing fluid flow may cause fluid to be ejected from the tube unit into the annulus.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. An expansion chamber for use on a tubular, the expansion chamber comprising:

a shell that is configured to be attached to the tubular by a bonding material, the shell having a port configured to receive the bonding material therethrough and into a cavity of the shell; and a tube unit configured to be placed in the cavity of the shell, the tube unit having a tube with a port that is in fluid communication with the port of the shell, wherein the tube unit is at least partially enveloped in the bonding material.

2. The expansion chamber of claim 1, wherein the tube unit comprises a piston configured to move within the tube in response to pressure external to the shell.

3. The expansion chamber of claim 2, wherein the tube unit comprises a piston chamber configured to resist displacement of the piston in a direction.

4. The expansion chamber of claim 3, wherein the piston chamber contains a gas at a pressure, wherein moving the piston in the direction causes the pressure of the gas to increase.

5. The expansion chamber of claim 3, wherein the tube engages an end of the piston chamber.

6. The expansion chamber of claim 1, wherein shell defines a plurality of tube ports, and the tube unit comprises a plurality of tubes extending parallel to one another in the cavity of the shell and communicating with an exterior of the shell via the plurality of tube ports.

7. The expansion chamber of claim 1, further comprising a rupture disk configured to block the port of the shell until the rupture disk breaks.

8. An expansion chamber for use on a tubular, the expansion chamber comprising:

a shell that is configured to be attached to the tubular by a bonding material, the shell having a port configured to receive the bonding material therethrough and into a cavity of the shell; and a tube unit configured to be placed in the cavity of the shell, the tube unit having a tube with a port that is in fluid communication with the port of the shell, wherein the shell is prefabricated and secured to the tubular using the bonding material.

9. An expansion chamber for use on a tubular, the expansion chamber comprising:

a shell that is configured to be attached to the tubular by a bonding material, the shell having a port configured to receive the bonding material therethrough and into a cavity of the shell; and a tube unit configured to be placed in the cavity of the shell, the tube unit having a tube with a port that is in fluid communication with the port of the shell, wherein the tube unit comprises a piston configured to move within the tube in response to pressure external to the shell, wherein the tube unit comprises a piston chamber configured to resist displacement of the piston in a direction, and wherein the piston extends from the piston chamber, at least partially through the tube.

10. An expansion chamber for use on a tubular, the expansion chamber comprising:

a shell that is configured to be attached to the tubular by a bonding material, the shell defining a cavity that is substantially enclosed when the shell is positioned on the tubular, an injection port configured to receive the bonding material therethrough and into the cavity, and a plurality of tube ports positioned through at least one axial face of the shell; and a tube unit positioned at least partially in the cavity and comprising one or more tube assemblies, each tube assembly comprising:

a tube having a port configured to communicate with one of the plurality of tube ports;

a piston positioned at least partially in the tube, and movable therein so as to vary a volume of the tube that is in communication with the one of the tube ports; and a piston chamber, the piston being received at least partially into the piston chamber, and the piston chamber being configured to resist movement of the piston in at least one direction with respect to the tube.

11. The expansion chamber of claim 10, wherein the tube unit is configured to be at least partially enveloped in the bonding material.

* * * * *